US008221142B2

(12) United States Patent
Sakamaki et al.

(10) Patent No.: US 8,221,142 B2
(45) Date of Patent: Jul. 17, 2012

(54) LEVER-TYPE CONNECTOR

(75) Inventors: Kazushige Sakamaki, Tokyo (JP); Ryuichi Komiyama, Tokyo (JP)

(73) Assignee: Tyco Electronics Japan G.K., Kanagawa-Ken (JP)

( * ) Notice: Subject to any disclaimer, the term of this patent is extended or adjusted under 35 U.S.C. 154(b) by 0 days.

(21) Appl. No.: 12/892,308

(22) Filed: Sep. 28, 2010

(65) Prior Publication Data

US 2011/0014805 A1 Jan. 20, 2011

Related U.S. Application Data

(63) Continuation of application No. PCT/JP2009/055275, filed on Mar. 18, 2009.

(30) Foreign Application Priority Data

Mar. 28, 2008 (JP) ..... 2008-087617

(51) Int. Cl.
*H01R 13/62* (2006.01)

(52) U.S. Cl. ..... 439/157

(58) Field of Classification Search ..... 439/157
See application file for complete search history.

(56) References Cited

U.S. PATENT DOCUMENTS

| | | | | |
|---|---|---|---|---|
| 6,065,982 | A * | 5/2000 | Okabe | 439/157 |
| 6,183,277 | B1 * | 2/2001 | Okabe et al. | 439/157 |
| 2007/0197071 | A1 * | 8/2007 | Patterson | 439/157 |

FOREIGN PATENT DOCUMENTS

| | | |
|---|---|---|
| JP | 11-503558 A | 3/1999 |
| JP | 2003-086301 A | 3/2003 |
| JP | 2008-27652 | 2/2008 |

OTHER PUBLICATIONS

International Search Report for issued in co-pending International Application No. PCT/JP2009/055275, 1 page, dated Jun. 9, 2009.

International Preliminary Report with Written Opinion co-pending PCT Application No. PCT/JP2009/055275, dated Nov. 18, 2010, 6 pages.

* cited by examiner

*Primary Examiner* — Truc Nguyen

(74) *Attorney, Agent, or Firm* — Barley Snyder

(57) ABSTRACT

A lever-type connector capable of simplifying a release operation for a lock of a lever locked by a lock while preventing the lock of the lever locked by the lock from unintentionally being released is provided. The lever-type connector includes a housing, a wire cover, a lever, and a lock. The housing includes a contact, while the wire cover attaches to a rear side of the housing. The lever includes a pair of side plates and a connecting part for connecting both of the side plates to each other. The lever bridges over the rear side of the wire cover and is rotatably attached to the housing between a release position and a mating position. The lock includes a cantilever plate-spring form and is positioned on the rear side of the wire cover in order to prevent rotation of the lever when set to the mating position.

18 Claims, 8 Drawing Sheets

Prior Art

LEVER-TYPE CONNECTOR

CROSS-REFERENCE TO RELATED APPLICATIONS

This application is a continuation of PCT International Application No. PCT/JP2009/055275, filed Mar. 18, 2009, which claims priority under 35 U.S.C. §119 to Japanese Patent Application No. JP 2008-087617, filed Mar. 28, 2008.

FIELD OF THE INVENTION

The present invention relates to a connector, and in particular to a lever-type connector to unite and release from a mating connector by rotation of a lever.

BACKGROUND

In recent years, electric connectors having numerous terminals are being used in the field of automobiles and the like, and are continually become more and more advanced. With an electric connector having numerous terminals, a large force is necessary to mate together connectors and release the connection. Therefore, in the field of automobiles and the like, a lever-type connector to mate with and release from a mating connector utilizing effect of boosting by a lever is used.

With a lever-type connector, mating with and releasing from a mating connector is carried out by rotation of the lever; wherein by setting the lever to a mating position, mating with the mating connector is completed. Here, with a lever-type connector, a lock is provided for preventing rotation of a lever that has reached the mating position towards a release position. Therefore, with the lever-type connector having been mated with the mating connector, connection with the mating connector is maintained by the lock, which prevents rotation of the lever that has reached the mating position towards the release position.

However, with the lever-type connector having been mated with the mating connector, there are situations where a lock of the lever, which is locked by the lock, is unintentionally released due to an external force applied to the lock. Moreover, with the lever-type connector, there are situations where the mating with the mating connector becomes incomplete once the lock of the lever locked by the lock is released.

Therefore, conventionally, a lever-type connector with a configuration that prevents the lock of the lever locked by the lock from being released unintentionally has been developed.

Conventionally, a lever-type connector shown in FIG. 14, for example, is well-known as a lever-type connector with a configuration that prevents the lock of the lever locked by the lock from being released unintentionally has been developed.

The lever-type connector 100 shown in FIG. 14 includes a connector housing 110, a lever 120, and a wire cover 130. The lever 120 is attached and rotatable relative to the connector housing 110, while the wire cover 130 is attached on a rear side of the connector housing 110.

The lever 120 has a pair of assembly legs 121 and a connecting part 122 for connecting the assembly legs 121 to each other. A cam groove 123, which leads in and pushes out a cam pin 120 on a mating connector 200, is provided on either of the assembly legs 121, respectively. A lock claw 124 is provided on the connecting part 122 and latches to a locking piece 111 provided on the connector housing 110. A release operation part 125 is provided on the end of the lock claw 124.

An erroneous release preventing part 131 formed expanding toward the rear is provided on the rear surface of the wire cover 130.

With the lever-type connector 100, the cam grooves 123 of both of the assembly legs 121 lead in the respective cam pins 210 of the mating connector 200 by rotating the lever 120 toward the mating position. Then, with the lever-type connector 100, the lock claw 124 of the connecting part 122 is latched onto the locking piece 111 of the connector housing 110 by positioning the lever 120 at the mating position, thereby completing mating with the mating connector 200.

With the lever-type connector 100 having been mated with the mating connector 200, it is difficult to exert an external force on the release operation part 125 of the lock claw 124 due to the erroneous release preventing part 131 of the wire cover 130. With the lever-type connector 100, this prevents latching of the lock claw 124 of the lever 120 onto the locking piece 111, which is on the connector housing 110, from being released unintentionally due to external force.

Generally, a lever-type connector for automobiles is assembled at a wiring harness manufacturer, and is delivered to an automobile manufacturer from the wiring harness manufacturer upon completion of assembly. At the car manufacturer, to which the lever-type connector has been delivered, the lever-type connector is loaded onto an automobile as well as mated with a mating connector in a vehicle assembly step.

Here, when mating the lever-type connector with the mating connector in the vehicle assembly step, temporary mating with the mating connector is necessary with the lever of the lever-type connector positioned at the release position. As a result, it is preferable for the automobile manufacturer that the lever of the lever-type connector is delivered from the wiring harness manufacturer with it set to the release position.

However, with the lever-type connector having the lever positioned at the release position, the end of the lever protrudes toward the outside of the wire cover. As a result, if the lever-type connector is transported in a state where the lever is positioned at the release position, the lever may be damaged due to external force impact during transportation. Particularly, with a lever-type connector having numerous terminals, an effect of boosting by a lever is increased by enlarging the lever since reactive force developed when mating with the mating connector increases. As a result, if the lever-type connector formed is transported in a state where the lever is positioned at the release position, damage of the lever due to impact during transportation more easily occurs.

Accordingly, in general, the lever-type connector is delivered to the automobile manufacturer in a state where the lever is positioned at the mating position and the lever is locked by the lock. Moreover, when mating the lever-type connector with the mating connector in the vehicle assembly step, temporary mating with the mating connector is then carried out after the lock is released and the lever is rotated until the release position.

However, the lever-type connector 100 shown in FIG. 14 has a configuration with which it is difficult to exert external force on the release operation part 125 of the lock claw 124 on the lever 120. Accordingly, with the lever-type connector 100, there is a problem of decrease in work efficiency since it takes time for a worker to release the latch of the lock claw 124 of the lever 120 on the locking piece 111 that is on the connector housing 110. In addition, with the lever-type connector 100, there is a problem where the lock claw 124 or the locking piece 111 is damaged when the worker releases the latch of the lock claw 124 on the locking piece 111 that is on the connector housing 110.

SUMMARY

The invention has been made to solve the above problems in the conventional lever-type connector, and it is an objective of the invention to provide a lever-type connector capable of simplifying the release operation for the lock of the lever by the lock while preventing the lock of the lever locked by the lock from unintentionally being released.

The lever-type connector includes a housing, a wire cover, a lever, and a lock. The housing includes a contact, while the wire cover attaches to a rear side of the housing. The lever includes a pair of side plates and a connecting part for connecting both of the side plates to each other. The lever bridges over the rear side of the wire cover and is rotatably attached to the housing between a release position and a mating position. The lock includes a cantilever plate-spring form and is positioned on the rear side of the wire cover in order to prevent rotation of the lever when set to the mating position.

BRIEF DESCRIPTION OF THE DRAWINGS

The invention is described in more detail in the following with reference to the embodiments shown in the drawings. Similar or corresponding details in the Figures are provided with the same reference numerals. The invention will be described in detail with reference to the following figures of which.

DETAILED DESCRIPTION OF THE EMBODIMENT(S)

Figure 1:
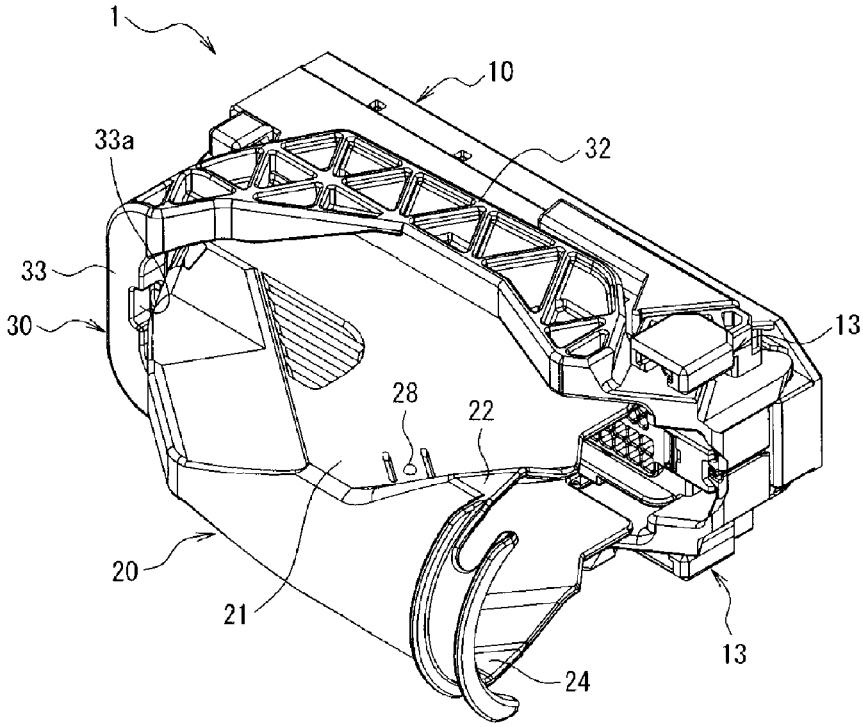
FIG. 1 is a perspective view a lever-type connector according to the invention, showing a top surface side.

Hereinafter, a lever-type connector according to the invention will be described with reference to the drawings.

The lever-type connector 1 shown in FIGS. 1 to 7 includes a housing 10, which accommodates multiple contacts (not illustrated in the drawings), a wire cover 20, which is attached to the rear side of the housing 10, and a lever 30, which is attached to the housing 10.

Figure 2:
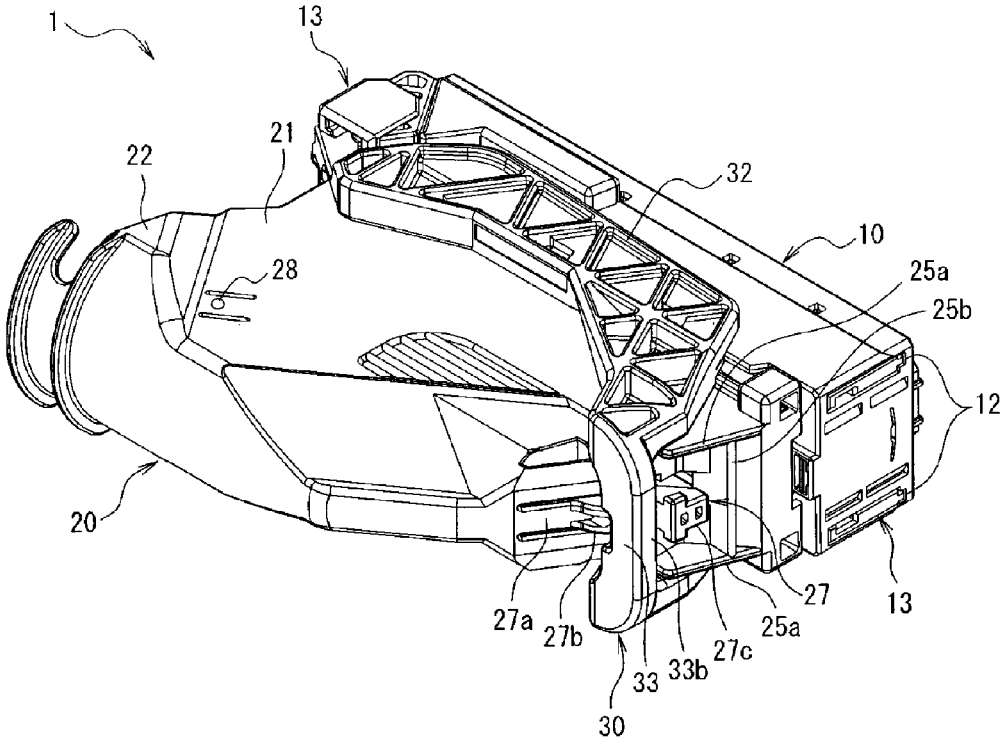
FIG. 2 is a perspective view of the lever-type connector of FIG. 1, showing a bottom surface side.
Figure 5:
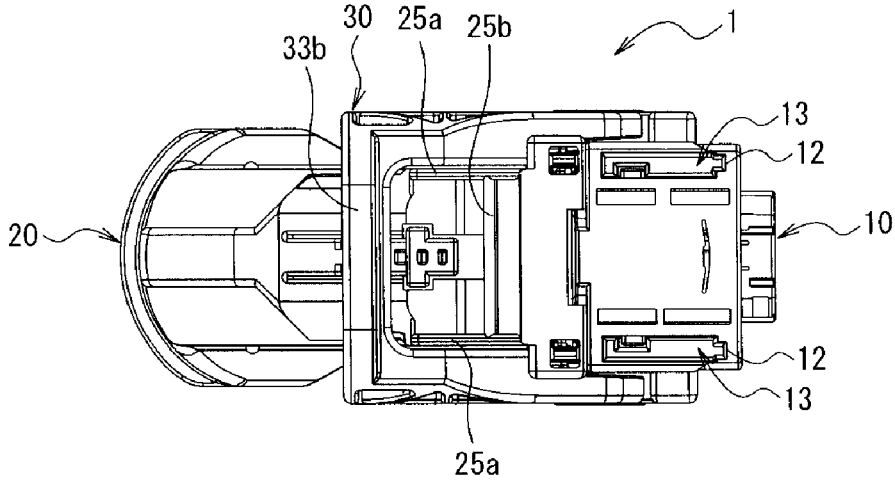
FIG. 5 is a side view of the other side of the lever-type connector of FIG. 1.
Figure 6:
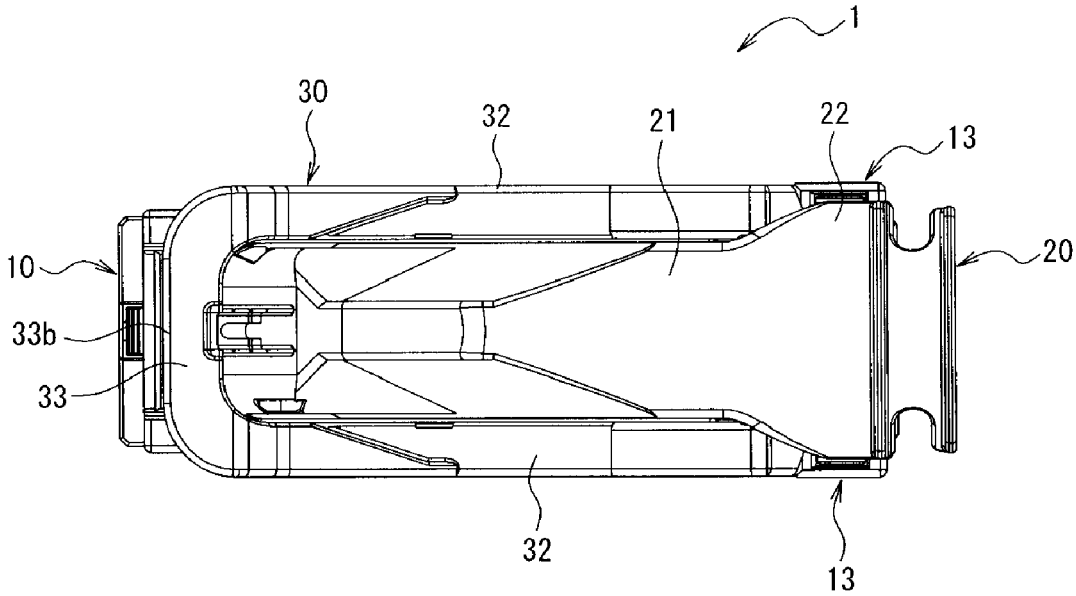
FIG. 6 is a rear view of the lever-type connector of FIG. 1.
Figure 7:
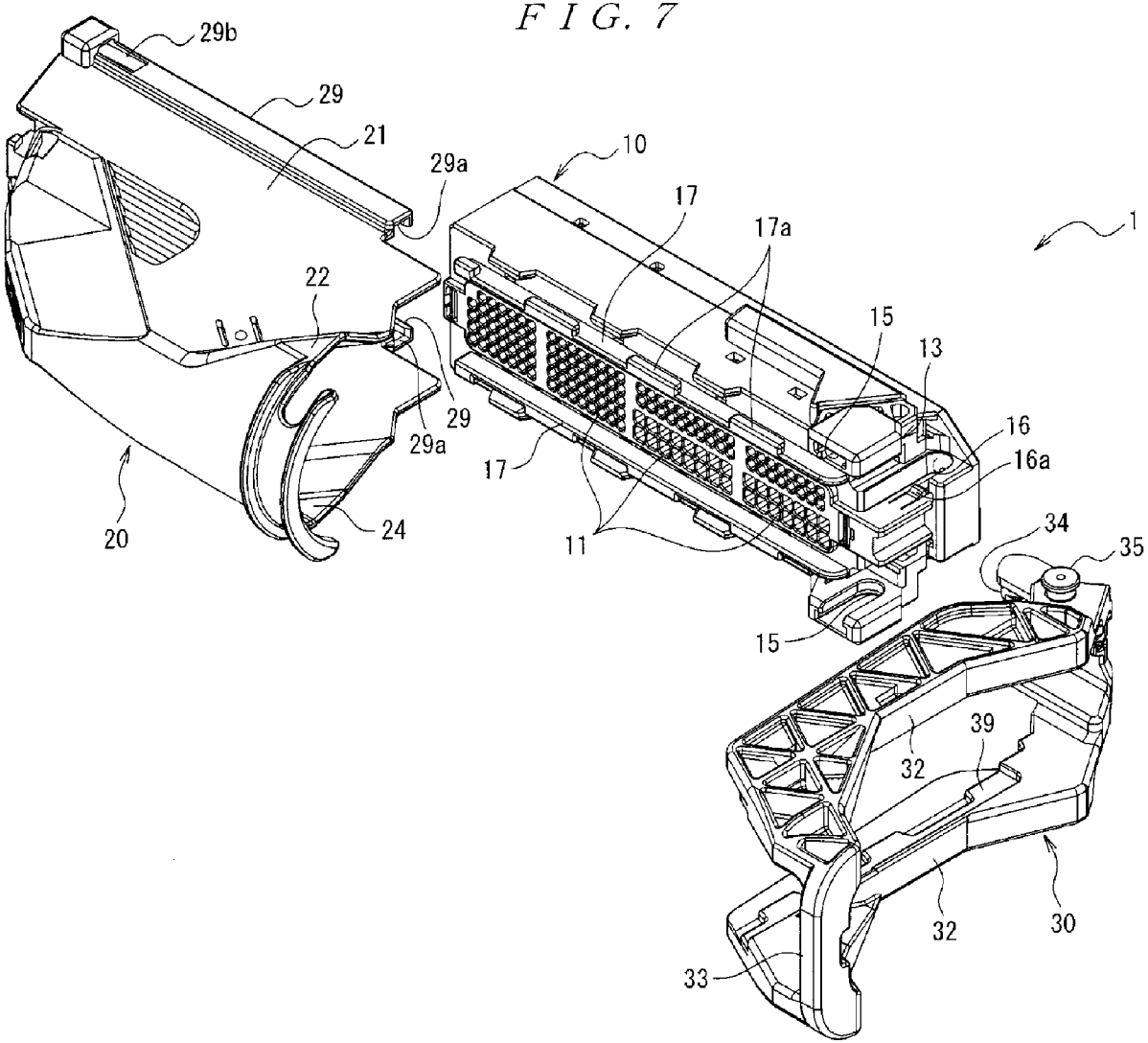
FIG. 7 is a perspective view of the lever-type connector of FIG. 1 in a disassembled state.

The housing 10 has multiple contact receiving holes 11, which pass through in the housing 10, as shown in FIG. 7. As shown in FIG. 2 and FIG. 5, a slider receiving slot 12 is provided and extends on either inner surface of the housing 10 (see FIGS. 4 and 5). A slider 13 is received in each of the sliding receiving slots 12 so as to move freely. As shown in FIG. 7, a pair of pivot receiving portions 16 is provided on an end of the housing 10, and join with pivots 34 of the lever 30, respectively. A latch arm 16*a* for locking the pivot 34 of the lever joined to each of the pivot receiving portions 16 is provided at the rear of each of the bearings of the housing 10. Fixing pieces 17 for fixing the wire cover 20 are provided on either end of the rear surface of the housing, as shown in FIG. 7. Both of the fixing pieces 17 are provided protruding toward the rear. Multiple (four in this embodiment) fixing projections 17*a*, which protrude toward the outside, are provided on the outer side surface of each of the fixing pieces 17.

Each of the sliders 13 is formed in a plate shape. Multiple cam grooves (not illustrated in the drawings), which lead in and push out cam pins (not illustrated in the drawings) provided on a mating connector, are provided on the inner surface of each of the sliders 13. Moreover, as shown in FIG. 7, projection receiving portions 15 respectively to which a slider moving projections 35 described later of the lever 30 are joined are each provided on an end of each of the sliders 13.

The lever 30 is formed in a U shape and includes a connecting part 33 for connecting a pair of side plates 32 extending and connecting the other ends of both of the side plates 32 to each other.

Figure 8:
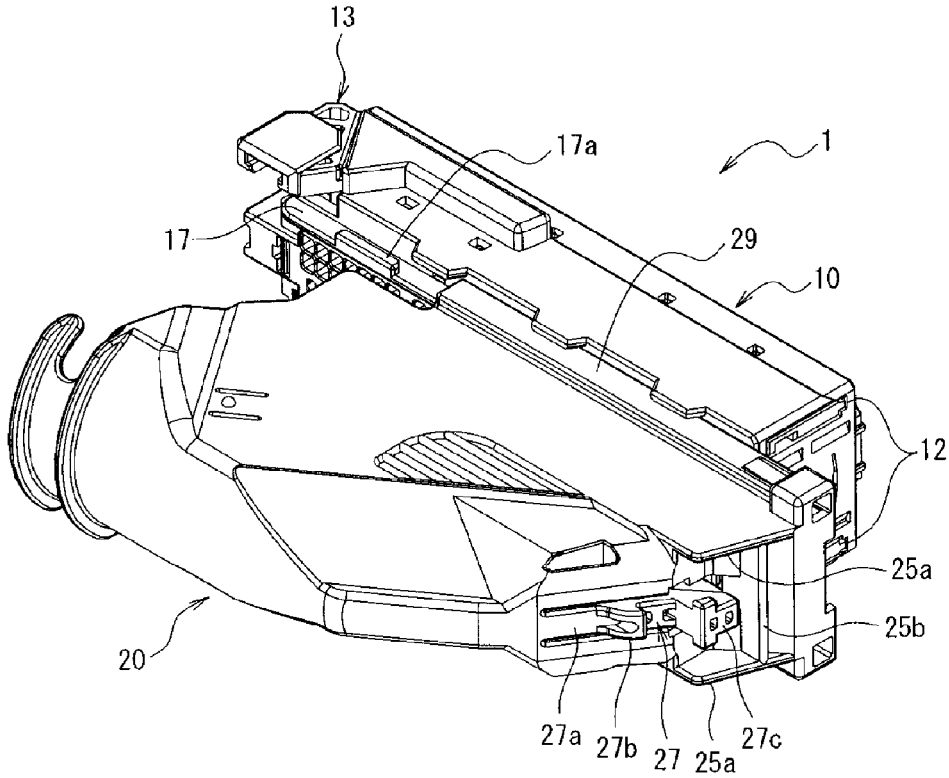
FIG. 8 is a perspective view of a bottom surface side and the other side of a wire cover and a housing of the lever-type connector according to the invention.

Each slider moving projection 35, which joins to the projection receiving portion 15 of each of the sliders 13, respectively, is formed protruding outward from an outer surface of an end of both of the side plates 32, as shown in FIG. 7 and FIG. 8. The pivot 34, which joins to each of the pivot receiving portions 16 of the housing 10, is provided and protrudes inward from the inner surface of the end of both of the side plates 32. Moreover, connecting plates 37, each extending inward, are provided on the inner surface of the end of both of the side plates 32, as shown in FIG. 8. Respective ends of both of the side plates 32 are joined to each other by a depression 37*a*, provided at the end of the connecting plate 37 of one of the side plates 32, and a projection 37*b*, which is provided on end of connecting plate 37 of the other side plates 32. Furthermore, a flat part 38 is formed on the inner surface on an end side of each of the side plates 32. The flat part 38 makes contact with a slant face 50*a* of the wire cover 20, when removing the lever 30 from the housing 10. In addition, notches 39 are provided on the inner surface of both of the side plates 32.

Figure 3:
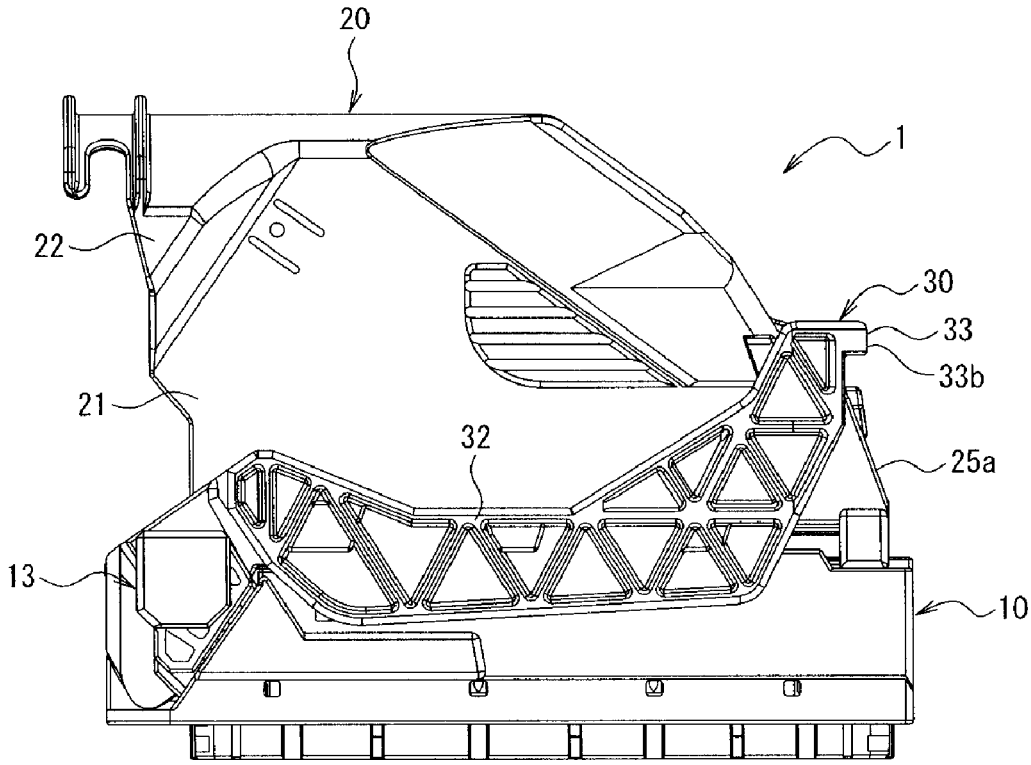
FIG. 3 is a plan view of the lever-type connector of FIG. 1.
Figure 4:
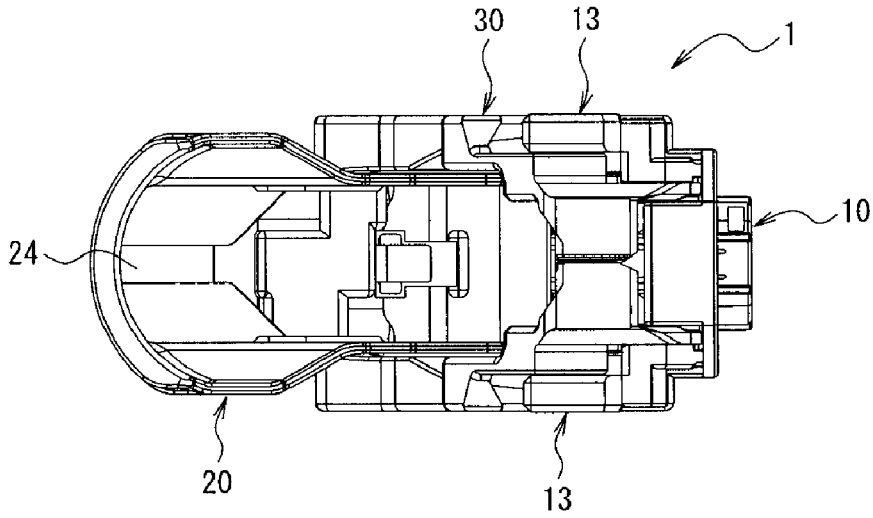
FIG. 4 is a side view of one side of the lever-type connector of FIG. 1.

As shown in FIG. 1, a depression 33*a* is provided to the connecting part 33, and latches to a locking piece 27*b* of a lock 27 of the wire cover 20. Moreover, as shown in FIG. 3, a protrusion 33*b* is provided on the connecting part 33, which is protruding toward the other side relative to a release projection 27*c* of a lock 27, which will be described later.

The wire cover 20 includes a main body 21, which covers electrical wires (not illustrated in the drawings) connected to the contacts contained in the housing 10, a stopper 22, which is provided on a side in the left-to-right direction of the main body 21, and a first tapered portion 50, which is formed between the main body 21 and the stopper 22. Thickness of the main body 21 is less than distance between both of the side plates 32 of the lever 30. Meanwhile, thickness of the stopper 22 is greater than the distance between both of the side plates 32 of the lever 30. As a result, the stopper 22 deters the lever 30 that has been rotated until the final position (see FIG. 10) at the rear from rotating further toward the rear.

An electrical wire outlet 24, which leads out the electrical wires connected to the contacts that are accommodated in the housing 10, is provided on an end of the stopper 22.

As shown in FIG. 2, the lock 27 is provided on the rear surface of the main body 21. The lock 27 prevents the lever 30, which has been rotated until the final position (see FIG. 12 and FIG. 13) on the front side, from rotating toward the rear side. The lock 27 is formed in a cantilever plate-spring form and extends from the rear side (one side) toward the front (other side) of the connecting part 33 of the lever 30 set to the mating position. The lock 27 has a plate spring 27*a*, and a locking piece 27*b* and a release projection 27*c* provided on the outer surface of the plate spring 27*a*. The plate spring 27*a* is formed extending from the rear side toward the front of the connecting part 33 of the lever 30 set to the mating position. The locking piece 27*b* is formed so as to latch onto the depression 33*a* of the connecting part 33 of the lever 30 set to the mating position. The release projection 27*c* is provided so as to be positioned on the front side of the connecting part 33 of the lever 30, which is set to the mating position. Moreover, the release projection 27*c* is provided so as to protrude toward the other side from the plate spring 27*a*.

A lock projection 28, which prevents the lever 30 that has been rotated until the mating position from rotating toward the rear, is provided on either of the top surface or the bottom surface of the main body 21. Each lock projection 28 is provided so as to latch onto the side of the notch 39 of each of the side plates 32 of the lever 30 set to the mating position.

A side wall 25*a*, which extends in the direction in which the release projection 27*c* protrudes, is provided on either side of the release projection 27*c* on the rear surface of the main body 21. A front wall 25*b*, which extends in the direction in which the release projection 27*c* protrudes, is provided on the front side of the release projection 27*c* on the rear surface of the main body 21. The front wall 25*b* and both of the side walls 25*a* are formed so as to protrude toward the other side relative to the release projection 27*c* of the lock 27.

Fixing parts 29 for fixing the wire cover 20 to the housing 10 are provided on the front end of the top surface and the front end of the bottom surface of the main body 21, as shown in FIG. 7. Both of the fixing parts 29 are provided so as to protrude outward. A fixing groove 29*a* into which the fixing projections 17*a* of the housing 10 are inserted is provided to the respective inner surfaces of the fixing parts 29. A latch arm 29*b* is provided on the other end of each of the fixing parts 29. Projections (not illustrated in the drawings) for latching onto the side of the fixing projections 17*a* of the housing 10 are provided on each of the fixing parts 29.

An assembling method of the lever-type connector 1 will now be described. When assembling the lever-type connector 1, contacts respectively connect to electrical wires (not illustrated in the drawings) are received in the multiple contact receiving holes 11 of the housing 10 of the lever-type connector 1 in the disassembled state, shown in FIG. 7. Moreover, the respective sliders 13 are inserted into both of the slider receiving slots 12 of the housing 10.

Next, the wire cover 20 is attached to the housing 10 receiving the multiple contacts. When attaching the wire cover 20 to the housing 10, the wire cover 20 arranged on the rear side of the housing 10 is slid from one side to the other side of the housing 10, as shown in FIG. 8. As a result, the multiple fixing projections 17*a* of both of the fixing pieces 17 of the housing 10 are inserted into the fixing grooves 29*a* of each of the fixing parts 29 of the wire cover 20. At this time, the multiple fixing projections 17*a* are inserted into the fixing grooves 29*a* from one side of the fixing grooves 29*a* in order from those on the other side in the left-and-right direction. Once the wire cover 20 slides and the sides of the fixing projections 17*a* provided furthest on the other side bump into wall surfaces on the other side of the fixing grooves 29*a*, attachment of the wire cover 20 to the housing 10 is complete.

When attachment of the wire cover 20 to the housing 10 is completed, the projections, which are provided on the latch arms 29*b* of the fixing parts 29, latching onto the sides on the other side of the fixing projections 17*a* provided furthest on the other side locks the wire cover 20. Moreover, when attachment of the wire cover 20 to the housing 10 is complete, the bound, electrical wires connected to the multiple contacts contained in the housing 10 are lead out from the electrical wire outlet 24 of the wire cover 20.

Figure 9:
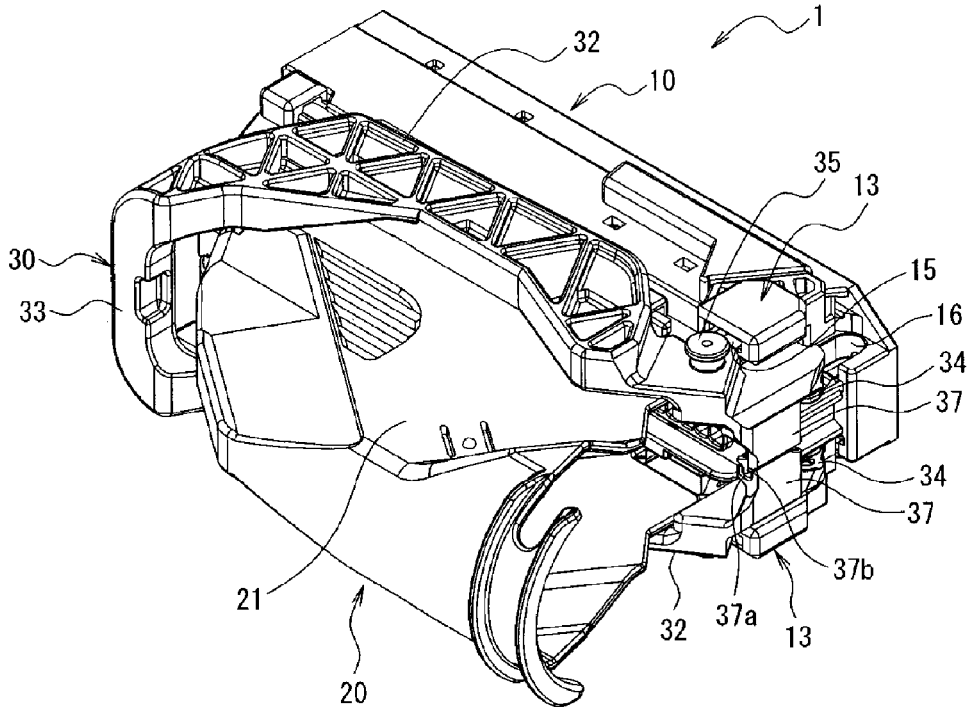
FIG. 9 is a perspective of the lever-type connector according to invention where the wire cover is inserted between side plates of the lever.

The lever 30 is then attached to the housing 10 to which the wire cover 20 is attached. When attaching the lever 30 to the housing 10 to which the wire cover 20 is attached, the wire cover 20 is first arranged so as for both of the side plates 32 to bridge over the rear surface of the wire cover 20, as shown in FIG. 9.

Then, the pivots 34 of both of the side plate 32 on the lever 30 are connected to respective pivot receiving portions 16 of the housing 10, and the slider moving projection 35 of the respective side plates 32 of the lever 30 is connected to respective projection receiving portions 15 of the sliders 13. This attaches the lever 30 to the wire cover 20, as shown in FIG. 1, thereby completing assembly of the lever-type connector 1.

Figure 10:
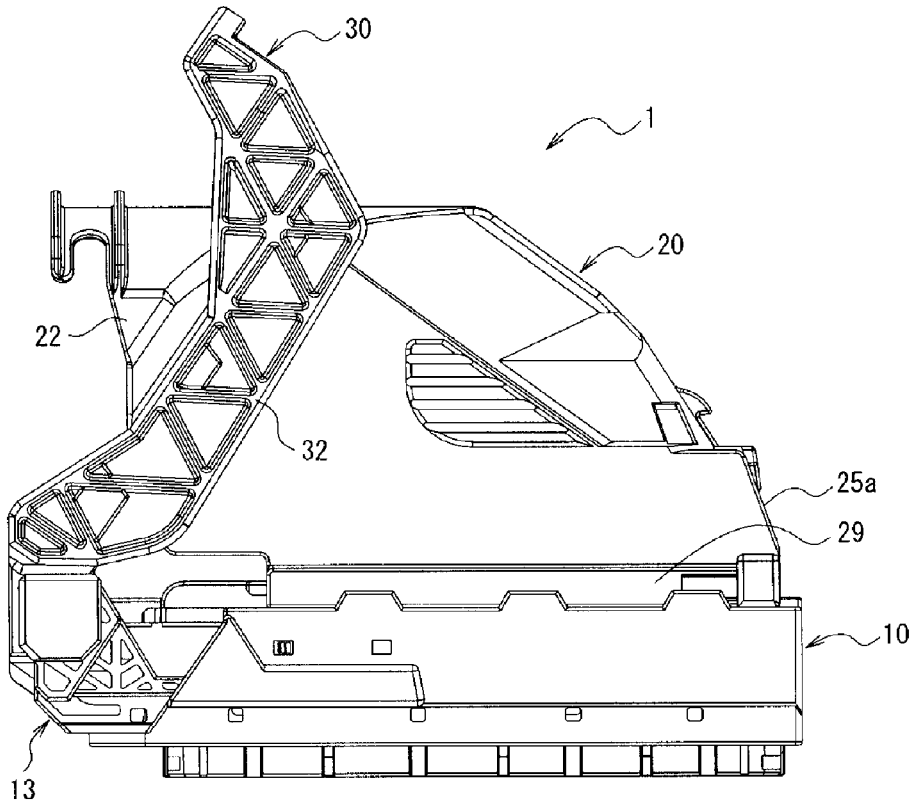
FIG. 10 is a plan view of a lever-type connector according to the invention, showing a lever positioned at a release position.

A method of use of the lever-type connector 1 will now be described. With the lever-type connector 1 in the assembled state shown in FIG. 1, if the lever 30 is rotated toward the front (other side), the sliders 13 move in the direction of going into the slider receiving slot 12 of the housing 10. Moreover, if the lever 30 is rotated toward the rear (one side), the sliders 13 are moved in the direction of coming out from the slider receiving slot 12 of the housing 10. When mating the lever-type connector 1 with a mating connector, the lever 30 is first rotated toward the rear so as to be set to the release position, as shown in FIG. 10. The lever 30 that is rotated until the final position on the rear side is in a state unable to be rotated any further toward the rear by the stopper 22. Moreover, the lever 30 that has been rotated until the final position on the rear side is when rotation toward the front is intercepted by the lock projection 28 of the main body 21 of the wire cover 20 latching onto the sides of the notches 39 of both of the side plates of the lever 30. Furthermore, when the lever 30 has been rotated until the final position on the rear side, the sliders 13 are moved in the direction of coming out from the slider receiving slot 12 of the housing 10 so as to allow insertion of cam pins provided on the mating connector into cam grooves of the sliders 13.

Then, when the lever 30 has been rotated until the final position on the rear side, the cam pins provided on the mating connector are inserted into the multiple cam grooves of the sliders 13, temporarily mating the lever-type connector 1 and the mating connector.

Next, the lever 30 locked by the lock projection 28 of the main body 21 of the wire cover 20 is released, and the lever 30 that has been set to the release position is rotated toward the front.

Once the lever 30 is rotated toward the front, the sliders 13 are moved in the direction of going into the slider receiving slot 12 of the housing 10 so that the cam grooves of the sliders 13 lead the cam pins that are provided to the mating connector toward the rear. As a result, the multiple contacts within the housing 10 of the lever-type connector 1 are mated with contacts within in the mating connector.

Figure 11:
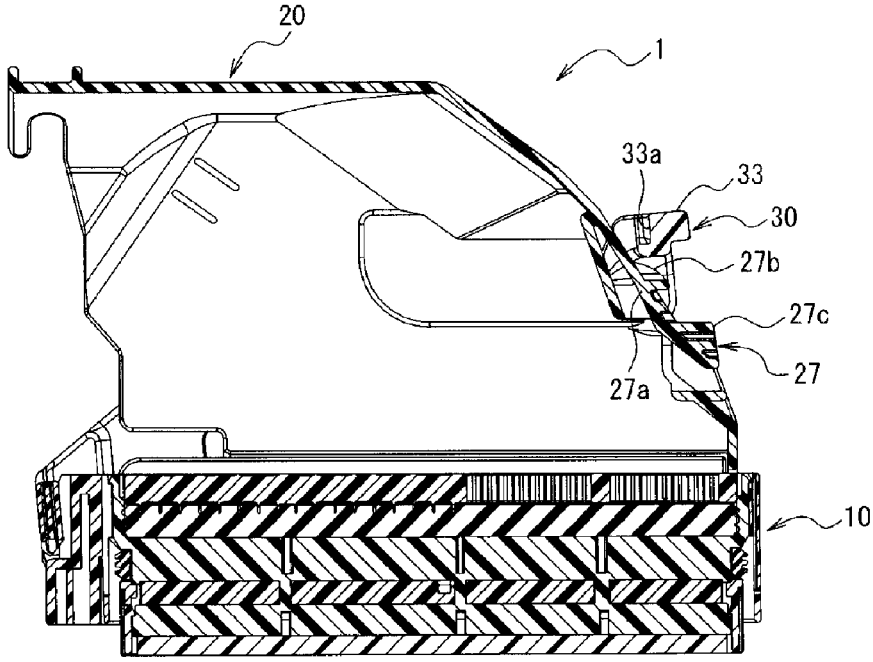
FIG. 11 is a cross-sectional view a lever-type connector according to the invention, showing a lever set between the release position and the mating complete position.

Once the lever 30 is rotated toward the front, as shown in FIG. 11, the front side of the connecting part 33 makes contact with the locking piece 27*b* of the lock 27 on the wire cover 20.

Figure 12:
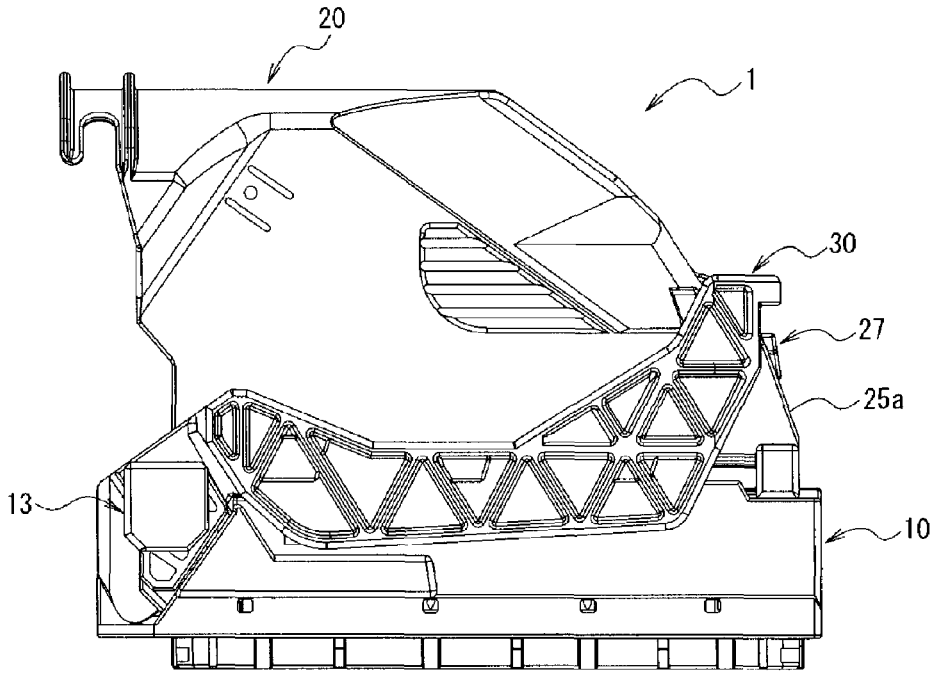
FIG. 12 is a plan view of a lever-type connector according to the invention, showing a lever positioned at a mating complete position.
Figure 13:
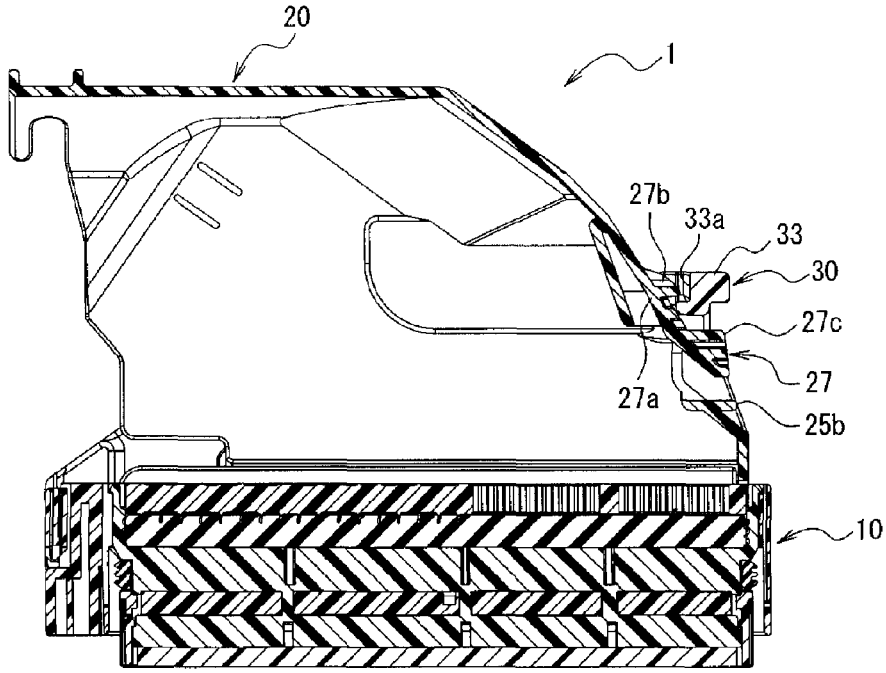
FIG. 13 is a cross-sectional view of the lever-type connector of FIG. 12.
Figure 14:
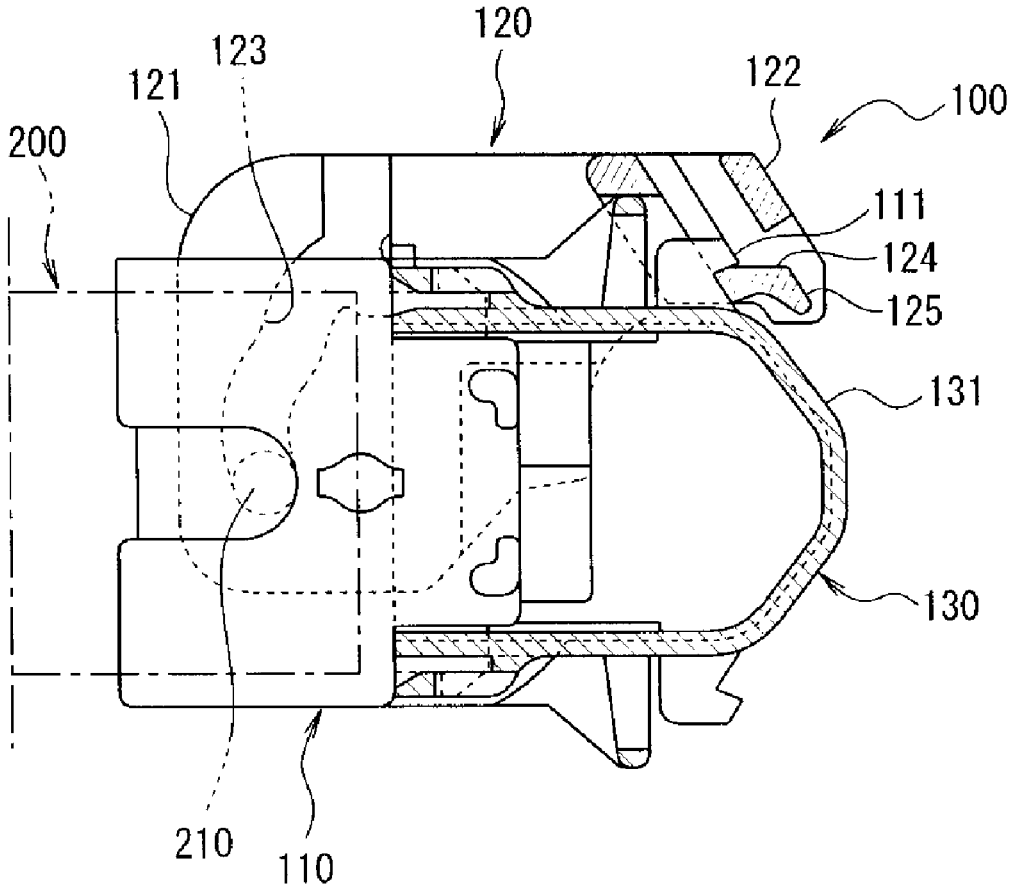
FIG. 14 is a side view of a known conventional lever-type connector.

Moreover, once the lever is further rotated toward the front, the plate spring 27*a* of the lock 27 is bent such that the connecting part 33 goes over the locking piece 27*b* of the lock 27. This brings the lever 30 set to the mating completion position, as shown in FIG. 12 and FIG. 13, mating of the lever-type connector 1 and the mating connector is complete.

The lever 30 that has been set to the mating position is unable to be rotated any further toward the front because the sides of the notches 39 of both of the side plates 32 keep in contact with the rear surface of the fixing parts 29 of the wire cover 20. Moreover, the lever 30 that has been set to the mating position is prevented from rotating toward the rear by the locking piece 27*b* of the lock 27 latching onto the depression 33*a* of the connecting part 33, as shown in FIG. 13.

Here, with the lever-type connector 1 having the lever 30 set to the mating completion position, the release projection 27*c* of the lock 27 is positioned on the front side of the connecting part of the lever 30. According to the lever-type connector 1, this may prevent exertion of external force from the rear side of the wire cover 20 on the release projection 27*c* of the lock 27. Therefore, according to the lever-type connector 1, prevention of the lever 30 locked by the lock 27 from being released unintentionally is possible.

Moreover, with the lever-type connector 1 having the lever 30 set to the mating position, the locking piece 27*b* of the lock 27 is hidden inside of the depression 33*a* of the connecting part 33 of the lever 30. Therefore, according to the lever-type connector 1, prevention of the lever 30 locked by the lock 27 from being released unintentionally is possible by external force exerted on the locking piece 27*b* of the lock 27.

Furthermore, with the lever-type connector 1 having the lever 30 set to the mating position, the release projection 27*c* of the lock 27 is enclosed by the protrusion 33*b* of the connecting part 33 and both of the side walls 25*a* and the front wall 25*b* of the wire cover 20. As a result, with the lever-type connector 1 having the lever 30 set to the mating position, the lever 30 locked by the lock 27 cannot be released except by inserting a finger in the space enclosed by the protrusion 33*b* of the connecting part 33 and both of the side walls 25*a* and the front wall 25*b* of the wire cover 20. Therefore, according to the lever-type connector 1, prevention of the lever 30 locked by the lock 27 from being released unintentionally is possible by external force exerted on the release projection 27*c* of the lock 27.

Meanwhile, in order to release the mated lever-type connector 1 and the mating connector, the lever 30 locked by the lock 27 is released, and the lever 30 that has been set to the mating position is rotated toward the rear.

In order to release the lever 30 locked by the lock 27, a fingertip is first inserted into the space enclosed by the protrusion 33*b* of the connecting part 33 of the lever 30 and both of the side walls 25*a* and the front wall 25*b* of the wire cover 20. The release projection 27*c* of the lock 27 is then pushed from the other side to the one side by the inserted fingertip. As a result, the plate spring 27*a* of the lock 27 bends inward, thereby releasing the latch of the locking piece 27*b* of the lock 27 onto the depression 33*a* of the connecting part 33 of the lever 30. At the same time, the pad of the finger pushing in the release projection 27*c* of the lock 27 makes contact with the front side of the connecting part 33 of the lever 30 and pushes out the connecting part 33 toward the rear. This makes the connecting part 33 of the lever 30 go over the locking piece 27*b* of the lock 27 to release the lever 30 locked by the lock 27.

Moreover, the connecting part 33 of the lever 30 locked by the lock 27 has been released is pulled on to the pad of the finger, thereby rotating the lever 30 toward the rear. Once the lever 30 is rotated toward the rear, the sliders 13 move in the direction of coming out from the slider receiving slot 12 of the housing 10, so that the multiple cam grooves of the sliders 13 push out the cam pins that are provided to the mating connector toward the front. As a result, the mating of the contacts within the housing 10 of the lever-type connector 1 and the contacts within the mating connector is released.

Once the lever 30 is rotated to the release position, as shown in FIG. 10, release of the mating of the lever-type connector 1 and the mating connector is then complete.

In this manner, with the lever-type connector 1 having the lever 30 set to the mating position, the release projection 27*c* of the lock 27 is positioned on the front side of the connecting part of the lever 30. As a result, when releasing the lever 30 locked by the lock 27, the worker may release the latch on the depression 33*a* of the locking piece 27*b* by pushing the release projection 27*c* with a finger and pull the front side of the connecting part 33 with the pad of the finger, thereby rotating the lever 30 toward the rear. Namely, the worker may carry out the release operation for the lever 30 locked by the lock 27 and the operation of rotating the lever 30 toward the rear in the same motion. Therefore, according to the lever-type connector 1, simplification of the release operation for the lever 30 locked by the lock 27 is possible.

Therefore, according to the lever-type connector 1, simplification of the release operation for the lever 30 locked by the lock 27, while preventing the lever 30 locked by the lock 27 from being released unintentionally, is possible.

While the embodiments of the present invention have been illustrated in detail, various modifications to those embodiments are possible. Those skilled in the art will appreciate that various modifications, additions and substitutions are possible, without departing from the scope and spirit of the invention as disclosed in the accompanying claims.

What is claimed is:

1. A lever-type connector comprising:

a housing having a contact;

a wire cover attached to a rear side of the housing and having an electrical wire outlet positioned on a front side of the wire cover;

a lever having a pair of side plates and a connecting part for connecting both of the side plates to each other, the lever bridging over a rear side of the wire cover, extending toward the front side of the wire cover, and being rotatably attached to the housing between a release position and a mating position; and a lock having a cantilever plate-spring positioned on the rear side of the wire cover opposite the electrical wire outlet in order to prevent rotation of the lever when set to the mating position.

2. The lever-type connector according to claim 1, wherein the lock includes a plate spring, a locking piece, and a release projection positioned on the plate spring.

3. The lever-type connector according to claim 1, further comprising a plate spring positioned on the lock and extending from one side toward an other side of the connecting part when set to the mating position.

4. The lever-type connector according to claim 1, further comprising a locking piece located on the lock, the locking piece locks onto the connecting part when set to the mating position.

5. The lever-type connector according to claim 1, further comprising a release projection located on the lock and positioned to a side of the connecting part when set to the mating position.

6. The lever-type connector according to claim 1, wherein a side wall is positioned on the rear surface of the wire cover and on either side of the lock.

7. The lever-type connector according to claim 1, further comprising a lock projection positioned on either of a top surface or a bottom surface of the wire cover, the lock projection prevents the lever from rotating rearwardly.

8. The lever-type connector according to claim 2, wherein the plate spring extends from one side toward another side of the connecting part when set to the mating position.

9. The lever-type connector according to claim 8, wherein the locking piece locks onto the connecting part when set to the mating position.

10. The lever-type connector according to claim 9, wherein the release projection is positioned on the other side of the connecting part when set to the mating position.

11. The lever-type connector according to claim 1, further comprising a depression positioned on a side surface of one side of the connecting part.

12. The lever-type connector according to claim 11, wherein the lock latches onto the depression when the lever is set to the mating position.

13. The lever-type connector according to claim 12, wherein a locking piece located on the lock latches onto the depression when the lever is set to the mating position.

14. The lever-type connector according to claim 6, wherein the side wall is positioned on either side of a release projection of the lock.

15. The lever-type connector according to claim 14, wherein a front wall is positioned on a rear surface of the wire cover and positioned on a front side of the lock.

16. The lever-type connector according to claim 15, wherein the front wall is positioned on a front side of a release projection of the lock.

17. The lever-type connector according to claim 16, wherein the front wall and side wall are positioned to protrude toward another side relative to the release projection of the lock.

18. The lever-type connector according to claim 7, wherein the lock projection latches onto a notch positioned on the pair of side plates.

* * * * *